US005707248A

United States Patent [19]

Matsumura

[11] Patent Number: 5,707,248

[45] Date of Patent: Jan. 13, 1998

[54] DEVICE FOR PREVENTING A WRONG COUPLING OF A CONNECTOR

[75] Inventor: Norio Matsumura, Shizuoka-ken, Japan

[73] Assignee: Yazaki Corporation, Tokyo, Japan

[21] Appl. No.: 661,730

[22] Filed: Jun. 11, 1996

[30] Foreign Application Priority Data

Jun. 12, 1995 [JP] Japan ..... 7-144579

[51] Int. Cl.[6] ..... H01R 3/00

[52] U.S. Cl. ..... 439/489; 439/352

[58] Field of Search ..... 439/350, 352, 439/357, 488, 489

[56] References Cited

U.S. PATENT DOCUMENTS 4,906,203 3/1990 Margrave et al. .
5,618,201 4/1997 Yagi et al. ..... 439/489

FOREIGN PATENT DOCUMENTS 1-274368 11/1989 Japan .
3-49174 3/1991 Japan .

*Primary Examiner*—Khiem Nguyen
*Assistant Examiner*—Yong Ki Kim
*Attorney, Agent, or Firm*—Finnegan, Henderson, Farabow, Garrett & Dunner, L.L.P.

[57] ABSTRACT

A device of the invention comprises a male type connector housing 100, a female type connector housing 200, a slider 300 for detecting a coupling state and for double locking, and a release projection 206 for cancelling a temporary engagement of the slider 300, and a reinforcing rib 207 which functions also for preventing a wrong coupling is provided on the release projection 206 projecting from the back wall of the female connector housing 200, and a reinforcing rib accommodating part which can accommodate only the reinforcing rib 207 provided in a specified position and cannot accommodate the reinforcing rib 207 provided in a non-specified position is provided continuously with a space of the male type connector housing 100 where the release projection 206 is to be inserted.

4 Claims, 19 Drawing Sheets

DEVICE FOR PREVENTING A WRONG COUPLING OF A CONNECTOR

BACKGROUND OF THE INVENTION

1. Field of the Invention

The present invention relates to a device for preventing a wrong coupling of a connector, which is used in connection of a wire harness for an automobile and the like.

2. Description of the Related Art

An example of connectors having a function of preventing a wrong coupling has been disclosed in a Japanese Patent laid-open No.3-49174.

In male connector housings and female connector housings shown in this example which are, respectively, equal to one another in shape of their coupling portions, a male connector housing has a projection in a position different from the other male connector housings on its outer circumferential wall, while a female connector housing is provided with a groove which only the projection of a male connector housing corresponding to it can fit on its inner circumferential wall, and therefore if attempting to couple wrong male and female connector housings with each other, since a projection of the male side interferes with the female connector housing, they cannot be coupled with each other. In this case, the female connector housing is provided with a swelling part expanded in outer dimension in order to provide a groove.

Another example is known as a connector having a fit detecting function disclosed in a Japanese Patent laid-open No.1-274368.

This connector comprises a male connector housing having a male connector part for control and a male connector part for detection, and a female connector housing for control and a female connector housing for detection which are to be respectively coupled with their corresponding male connector parts. The male connector part for control is provided with embossed ridge parts on its outer circumferential wall, and corresponding to them the female connector housing for control is provided with grooves to accommodate the embossed ridge parts on its inner circumferential wall. And the male connector part for detection is provided with embossed ridge parts, and corresponding to them the female connector housing for detection is provided with grooves to accommodate the embossed ridge parts. In this case also., in order to provide grooves to accommodate the embossed ridge parts the female connector housings are provided with swelling parts expanded in outer dimension.

This connector attempts to prevent a wrong coupling by that the male connector part for control and the female connector housing for control, and the male connector part for detection and the female connector housing for detection, respectively, cannot be coupled with each other in case that their embossed ridges and their grooves are not matched with each other.

This connector is provided with a fit detecting function as follows.

When the male connector part for control is not fitted into the female connector housing for control, even if attempting to fit the male connector part for detection into the female connector housing for detection, the male connector part for detection cannot be fitted into the female connector housing for detection since a locking arm of the female connector housing for detection interferes with a locking projection of the male connector part for detection. Thus this makes it possible to detect that the male connector part for control is not yet fitted into the female connector housing for control.

When the male connector part for control is incompletely fitted into the female connector housing for control, since an arm of the female connector housing for control interferes with an embossed ridge part of the male connector part for control, the arm deforms to block the way of a locking arm of the female connector housing for detection. Therefore, the male connector part for detection cannot be fitted into the female connector housing for detection, and by this it is possible to detect the incomplete fitting of the female connector housing.

When the male connector part is completely fitted into the female connector housing for control, since the arm of the female connector housing for control does not deform it does not block the way of the locking arm of the female connector housing for detection. Since a guide part of the female connector housing for control engages with a locking projection of the male connector part for control, the locking arm of the female connector housing for detection can get over the locking protection. Therefore, it is possible to slide the female connector housing for detection to the actual engaging position, and so it is possible to detect the complete fitting of the female connector housing for control and the male connector part for control.

By the way, since an existing connector is provided with a projection part (ridge part) and a groove on the outer and the inner circumferential wall of fitting parts of its male and its female connector housing, it has a problem that the outer dimensions of its fitting parts are expanded and with this an amount of molding material of it is increased.

SUMMARY OF THE INVENTION

In consideration of the above-mentioned problem, an object of the invention is to provide a device for preventing a wrong coupling of a connector which can avoid enlarging in size and increasing in molding material caused by being provided with a means for preventing a wrong coupling.

A device of the invention as defined in claim 1 comprises;

a pair of connector housings to be coupled face to face with each other, a slider mounted on one of the connector housings so as to be freely slid, which is unable to be moved to an actual engaging position and is stopped at a temporary engaging position when both connector housings are incompletely coupled as well as is able to be moved to the actual engaging position when they are completely coupled, a release projection, which is provided on the back wall of the other connector housing so as to project from it, for cancelling a temporary engagement of the slider by entering into an insertion space of one connector housing when the connector housings are completely coupled, a reinforcing rib provided in a specified position on the circumferential surface of the release projection, and a reinforcing rib accommodating part provided continuously with the insertion space, which can accommodate only the reinforcing rib provided in a specified position and cannot accommodate the reinforcing rib provided in any other position than the specified position.

A device of the invention as defined in claim 2 is a device for preventing a wrong coupling of a connector as defined in claim 1, wherein;

said reinforcing rib is extended to the inner circumferential wall of the other connector housing and is continued with said inner circumferential wall.

A device of the invention as defined in claim 3 is a device for preventing a wrong coupling of a connector as defined in claim 1, wherein;

said one connector housing is provided with a flexible locking arm for locking both connector housings in a complete coupling state, and said slider is provided with a bending locking part for preventing said locking arm from bending in a direction of releasing an engagement when said slider is moved to the actual engaging position.

A device of the invention as defined in claim 4 is a device for preventing a wrong coupling of a connector as defined in claim 1, wherein;

said one connector housing is provided with a first and a second stopper for stopping said slider in said temporary engaging position by blocking movement of said slider to the actual engaging position, said slider is provided with a first and a second flexible arm, respectively, having engaging parts corresponding to said first and said second stopper, the said other connector housing is provided with a first and a second release operation part for cancelling said first and said second stopper's action of blocking movement of said slider when said connector housings are completely coupled, at least one of said first and said second stopper is disposed inside said one connector housing, and said release projection is provided as a release operation part corresponding to the stopper disposed inside.

In a device of the invention as defined in claim 1, in case that a reinforcing rib accommodating part provided in one connector housing and a reinforcing rib provided on the other connector housing are matched with each other, since the reinforcing rib is accommodated in the reinforcing rib accommodating part when a release projection enters into an insertion space, both connector housings can be completely coupled with each other. Since a temporary engagement of a slider is released by the release projection in a complete coupling state, the slider can be moved to an actual engaging position and by this it is possible to detect that the connector housings are completely coupled with each other. Since the reinforcing rib formed on the circumferential surface of the release projection reinforces the release projection which is a cantilever projecting from the back wall, even if the front end of the slider strikes against the end of the release projection when releasing a temporary engagement of the slider, the release projection can be prevented from deformation and it is possible to surely release the temporary engagement.

In case that a reinforcing rib accommodating part provided in one connector housing and a reinforcing rib provided on the other connector housing are not matched with each other, the reinforcing rib accommodating part cannot accommodate the reinforcing rib when attempting to couple both connector housings. Therefore, both connector housings cannot be coupled with each other and so it is possible to prevent coupling of wrong connector housings with each other.

In a device of the invention as defined in claim 2, since the reinforcing rib is extended to the inner circumferential wall of a connector housing to be continued with the inner circumferential wall, a reinforcing effect upon the release projection is increased. The increased strength of the reinforcing rib itself can prevent deformation of the reinforcing rib in case that the reinforcing rib and a wall around the reinforcing rib accommodating part interfere with each other by attempting to couple wrong connector housings with each other.

In a device of the invention as defined in claim 3, both connector housings are locked by a locking arm when they are completely coupled with each other. Furthermore, a bending locking part provided on the slider prevents bending of the locking arm by moving the slider to the actual engaging position in that state. The connector housings are locked so that the locking arm may not be released from the locked state, and thus the connector housings are double locked in a complete coupling state.

In a device of the invention as defined in claim 4, the slider is surely stopped in a temporary engaging position by two stoppers. In this case, since at least one stopper is inside a connector housing, a flexible arm of the slider to strike against it is also hidden inside the connector housing. Therefore, there is hardly a possibility that an external force is applied to the flexible arm from any cause.

DESCRIPTION OF THE PREFERRED EMBODIMENT OF THE INVENTION

An embodiment of the present invention is described in the following with reference to the drawings.

Figure 1:
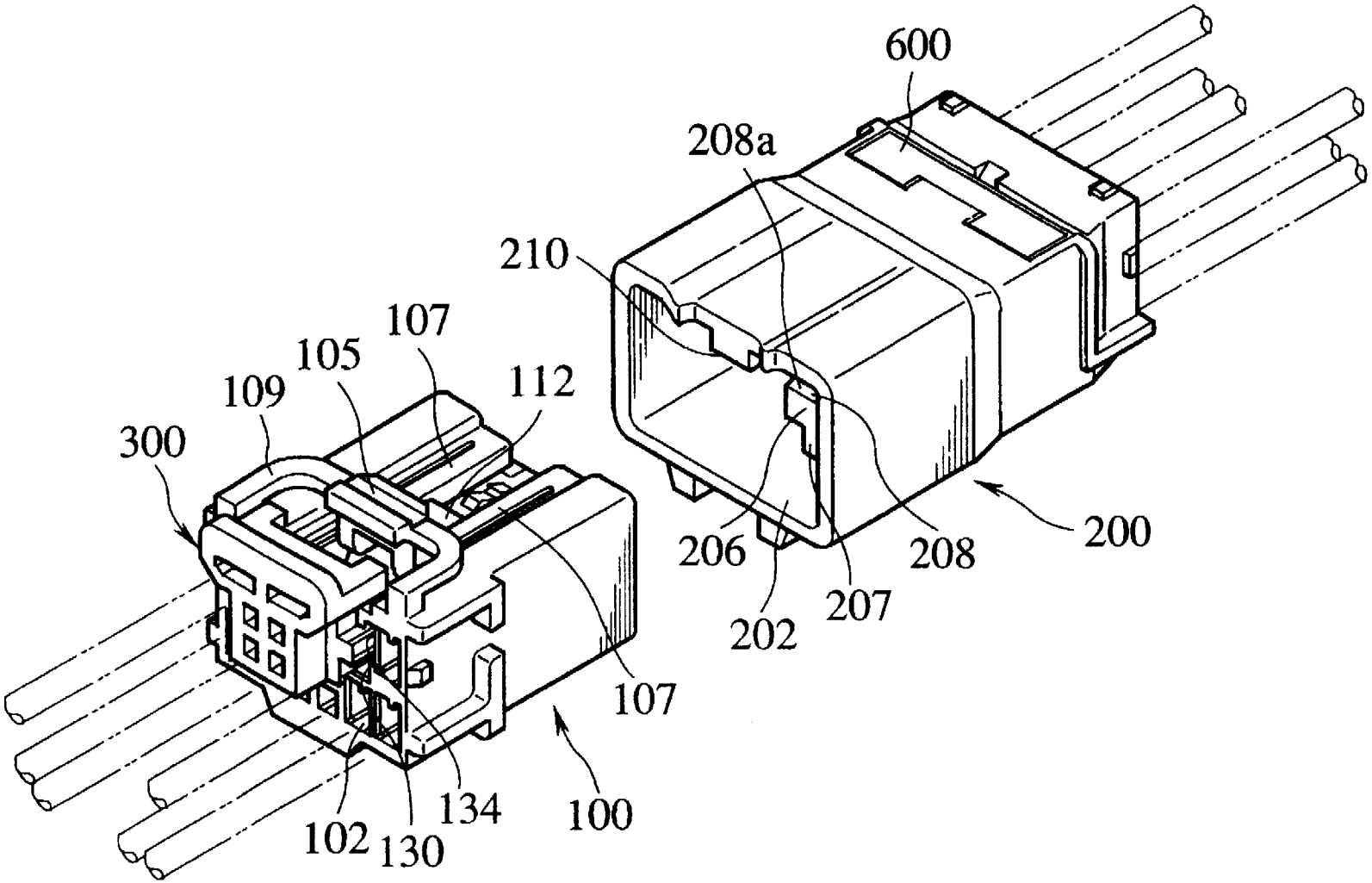
FIG. 1 is a perspective view showing a state before connector housings of an embodiment of the invention are coupled with each other.
Figure 2:
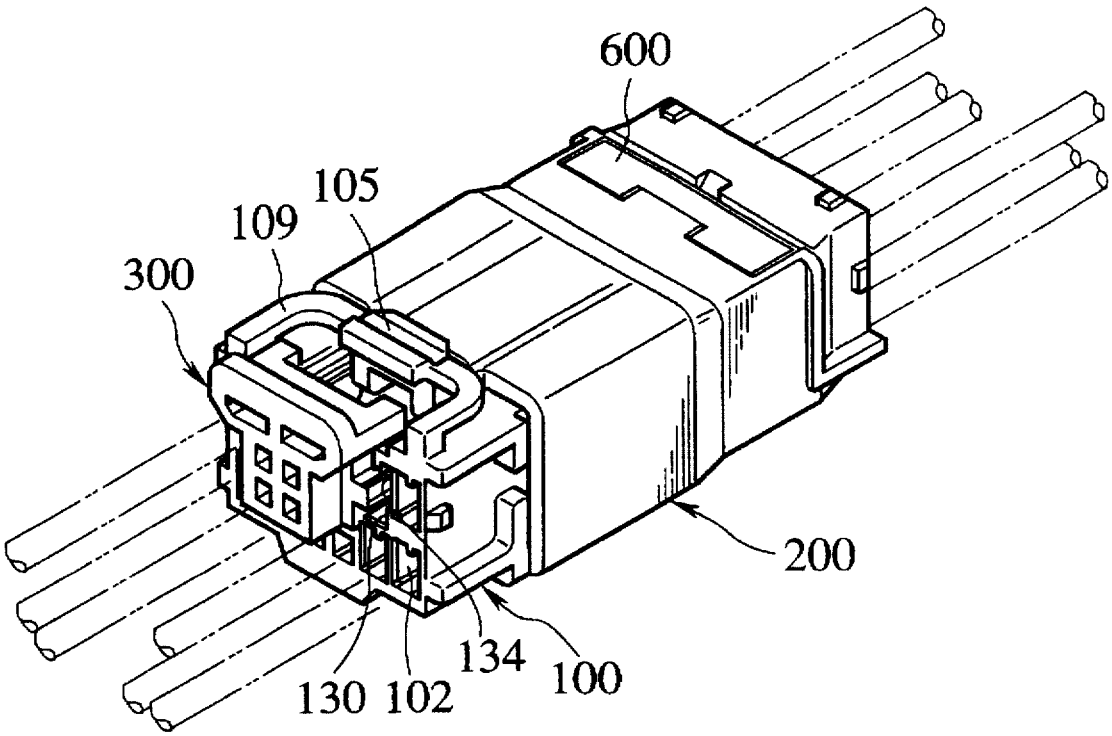
FIG. 2 is a perspective view showing a state just before a slider is inserted in the embodiment.
Figure 3:
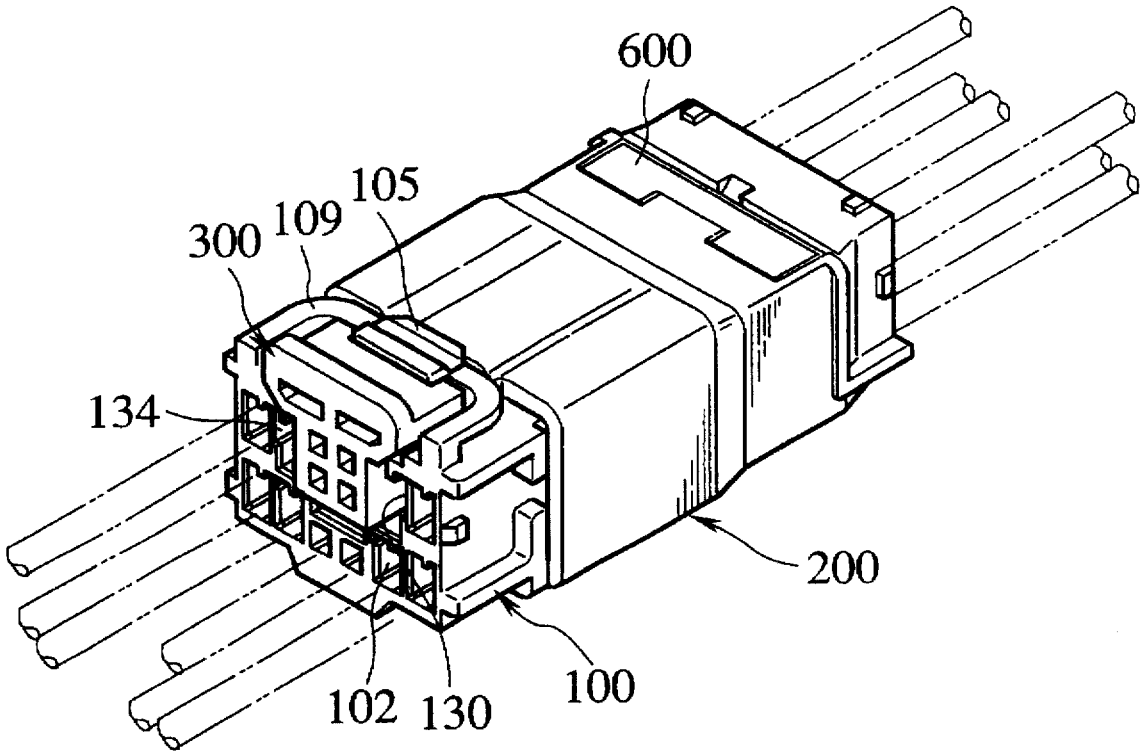
FIG. 3 is a perspective view showing a state where the slider has been inserted in the embodiment.

FIG. 1 is a perspective view showing a state before the male and the female part of a connector of the embodiment are coupled with each other. FIG. 2 is a perspective view showing a state where they have been coupled but a slider is not inserted yet. FIG. 3 is a perspective view showing a state where the slider has been inserted.

This connector comprises a male type connector housing 100 and a female type connector housing 200 which are to be coupled face to face with each other, and a slider 300 which is mounted on the male type connector housing 100 so as to be freely slid on it. A plurality of terminal insertion holes 102 of the male type connector housing 100 and a plurality of terminal insertion holes (not illustrated) of the female type connector housing 200 respectively accommodate terminals (not illustrated) which are to be coupled with one another.

The male type connector housing 100 has a slider accommodating room 130 for accommodating the slider 300 in the middle of the rear end side and has a plurality of terminal insertion holes 102 round it, as shown in FIG. 1.

Figure 4:
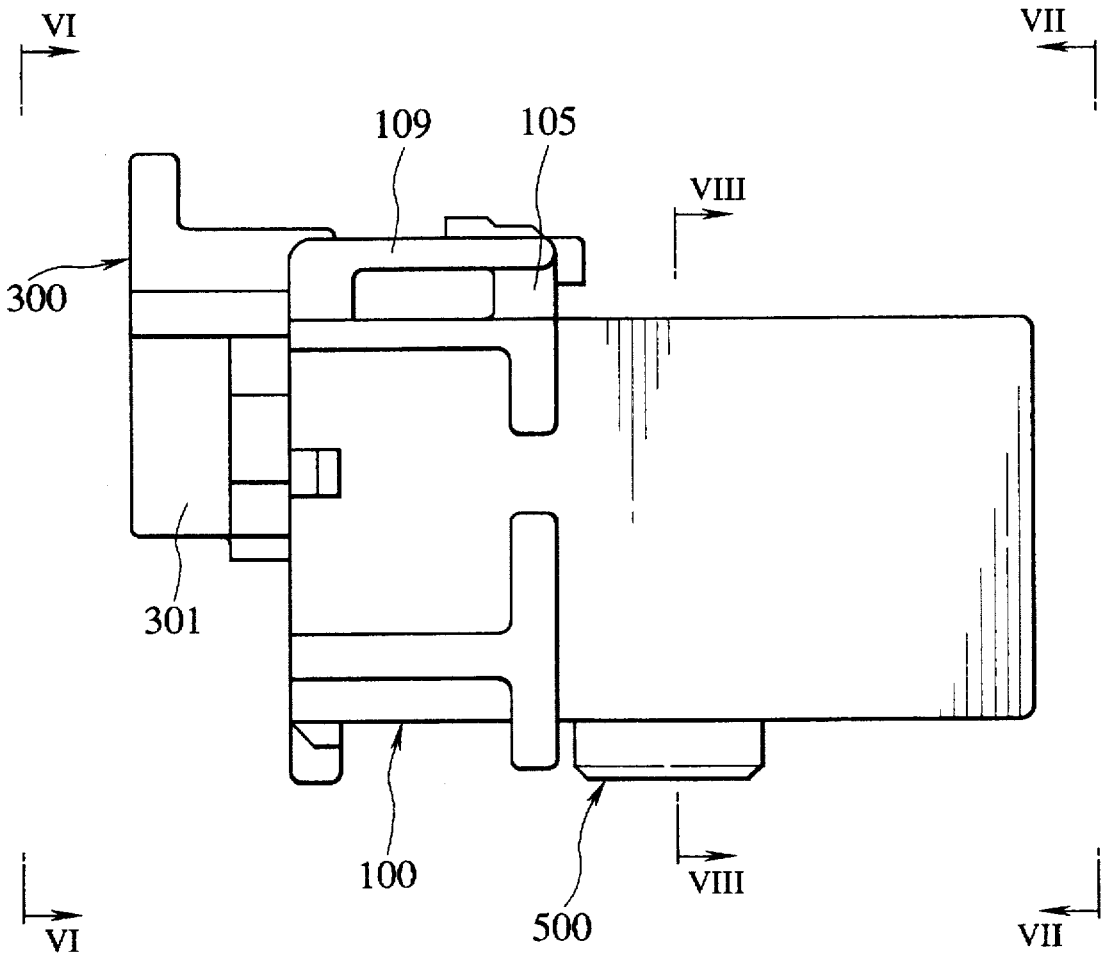
FIG. 4 is a side view showing a state where the slider is integrated into a male type connector housing 100 in the embodiment.
Figure 5:
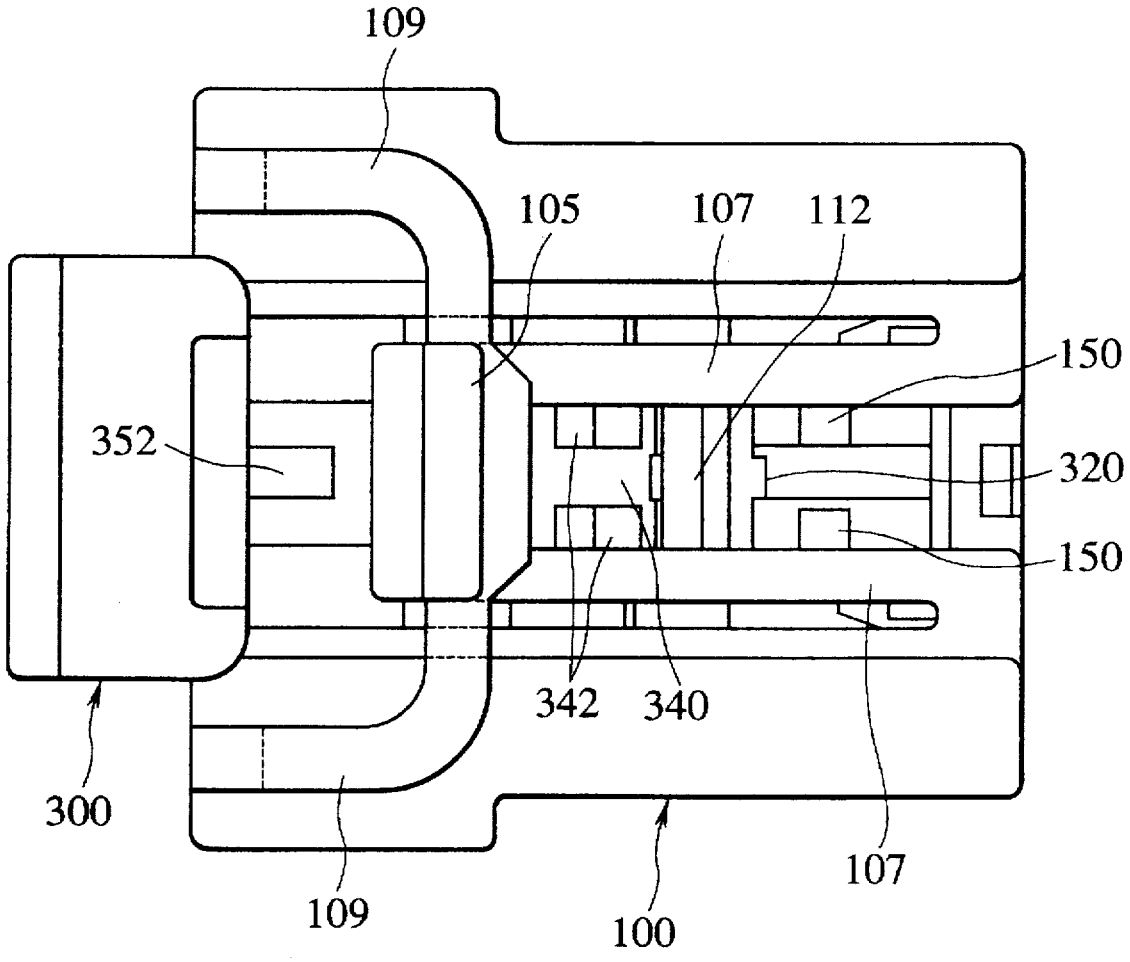
FIG. 5 is a plan view showing a state where the slider is integrated into the male type connector housing 100 in the embodiment.
Figure 6:
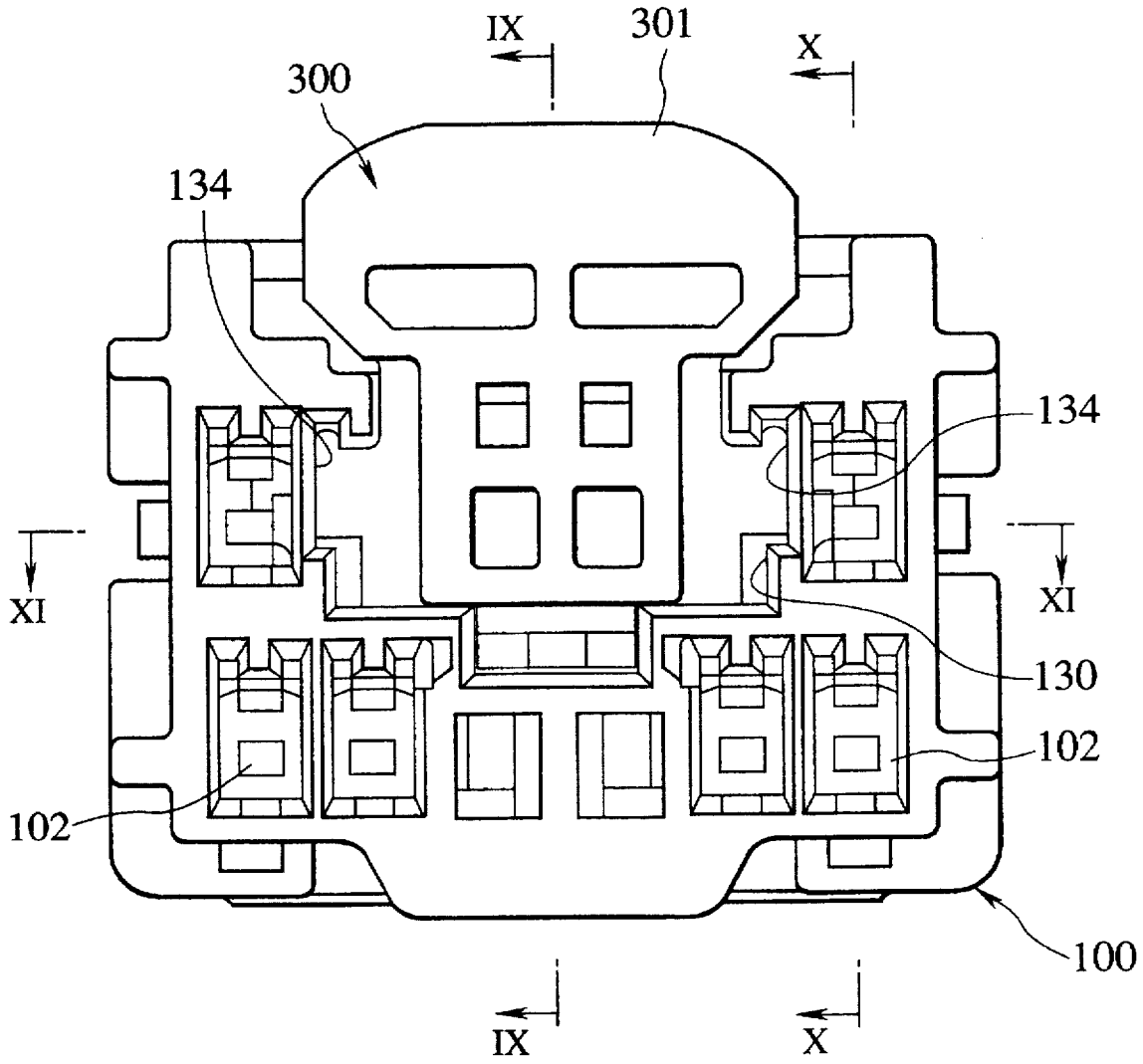
FIG. 6 is a sectional view taken in the direction of the arrow VI—VI (rear view) in FIG. 4.
Figure 7:
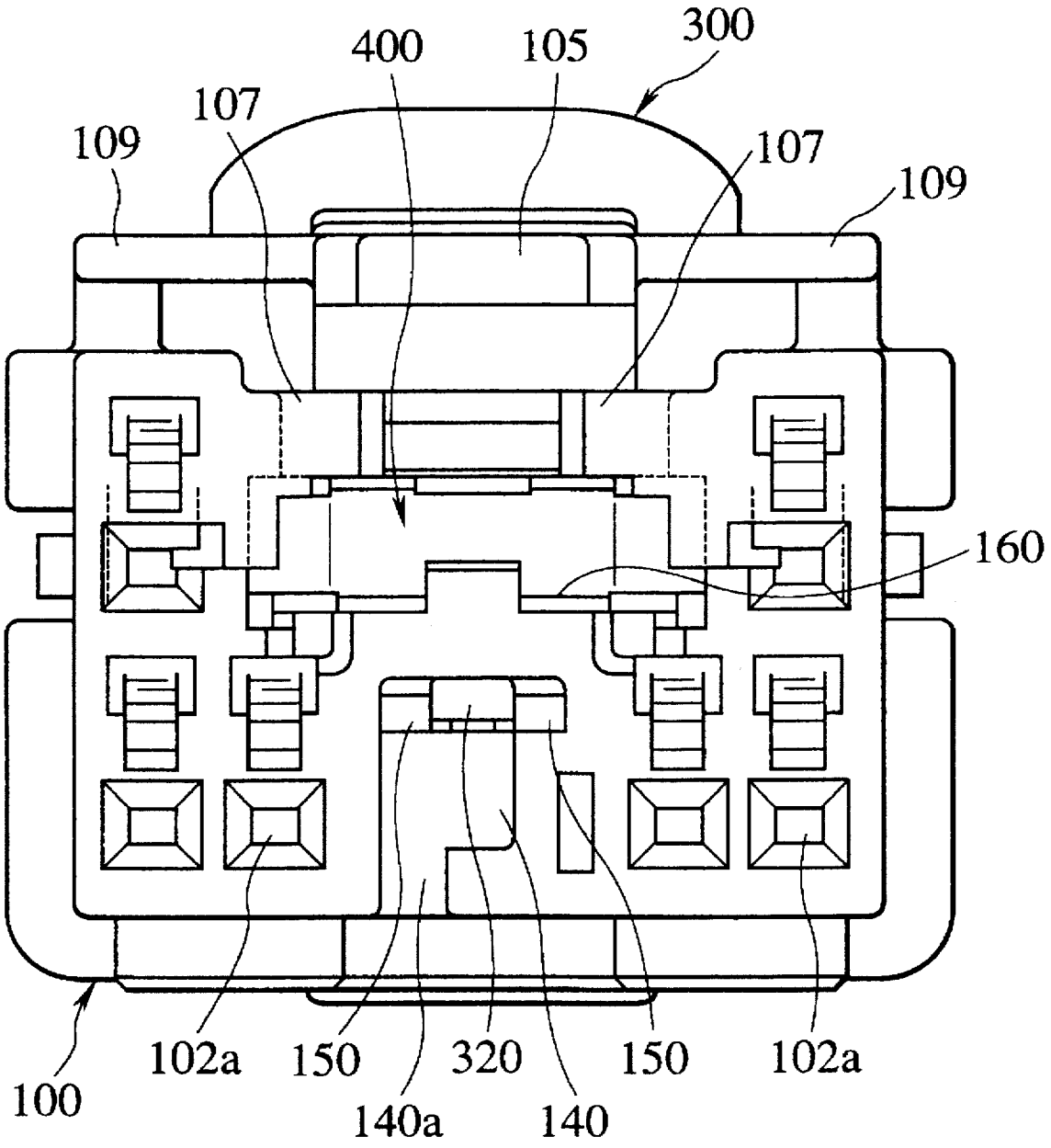
FIG. 7 is a sectional view taken in the direction of the arrow VII—VII (front view) in FIG. 4.
Figure 8:
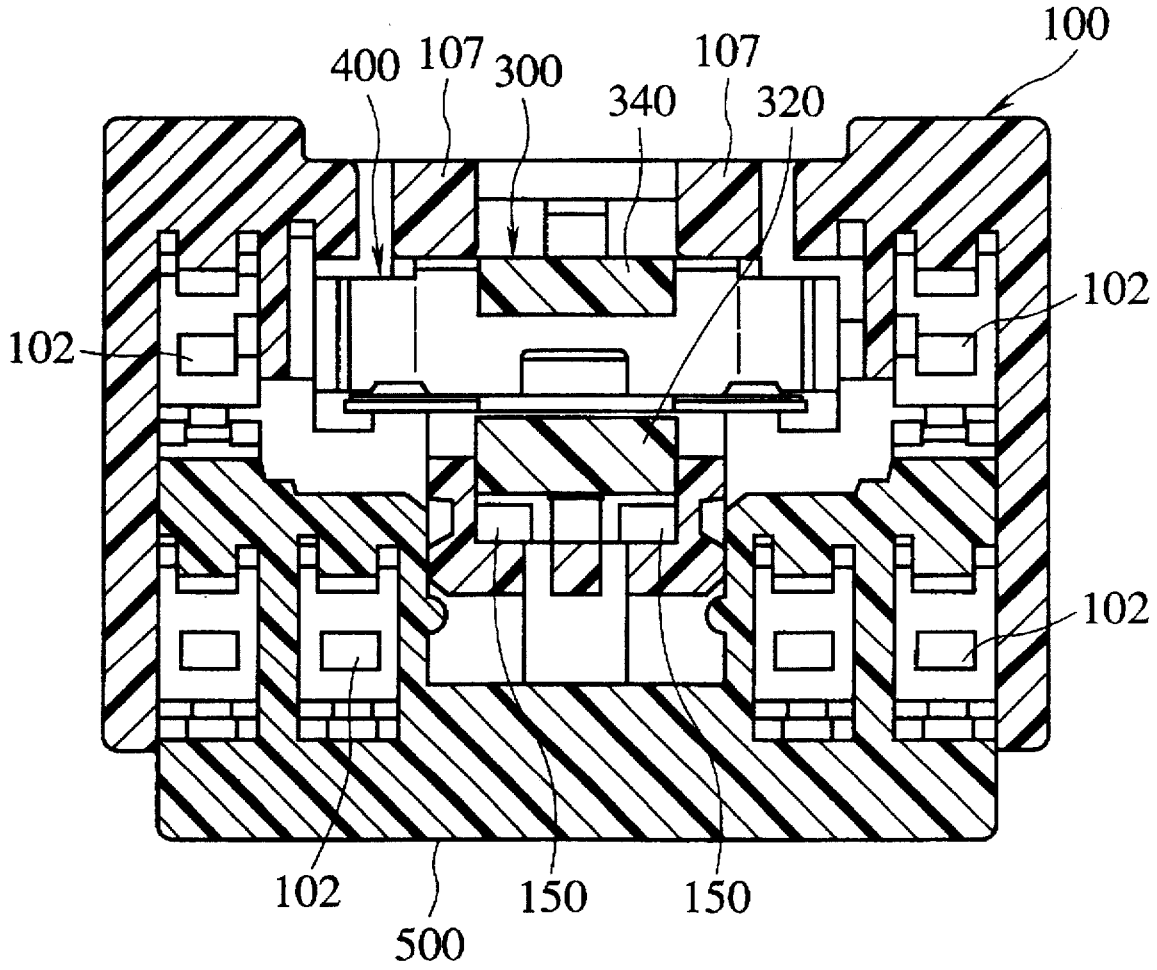
FIG. 8 is a sectional view taken in the direction of the arrow VIII—VIII in FIG. 4.
Figure 9:
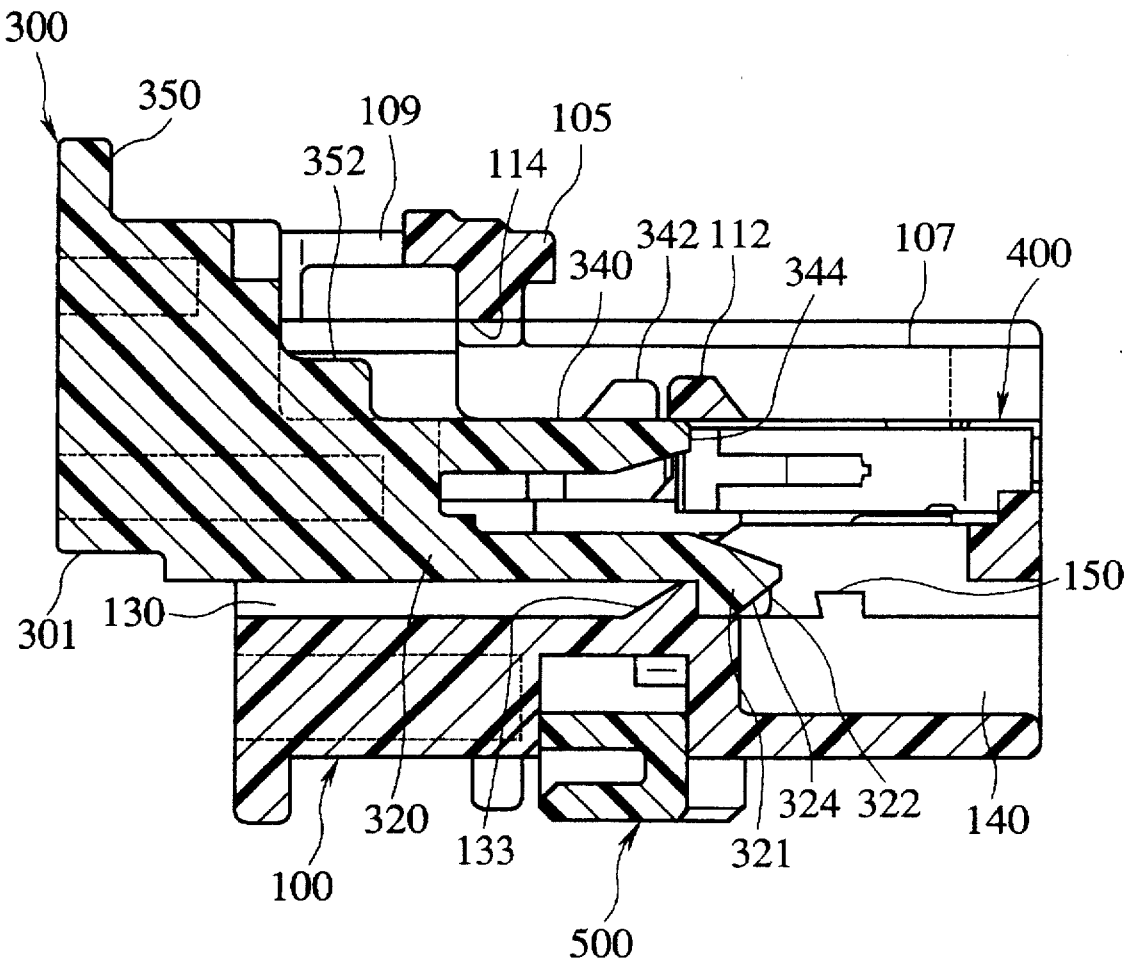
FIG. 9 is a sectional view taken in the direction of the arrow IX—IX in FIG. 6.
Figure 10:
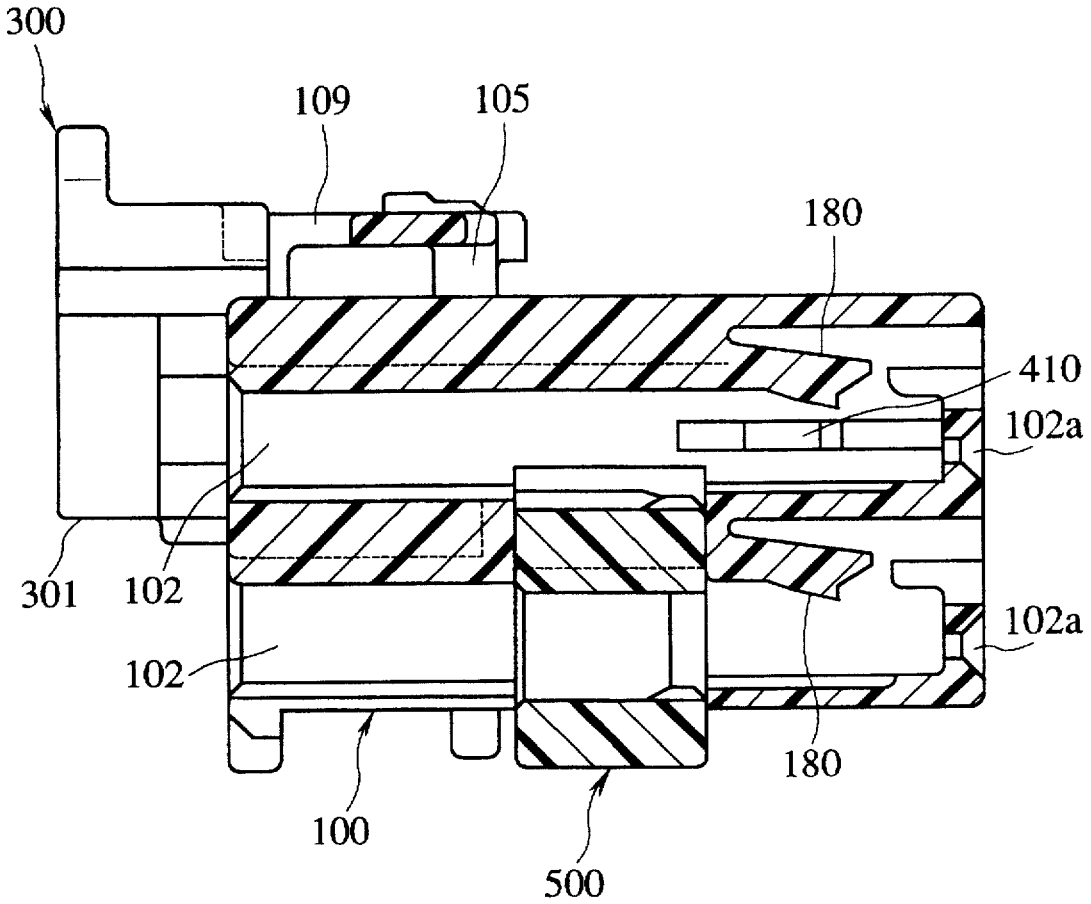
FIG. 10 is a sectional view taken in the direction of the arrow X—X in FIG. 6.
Figure 11:
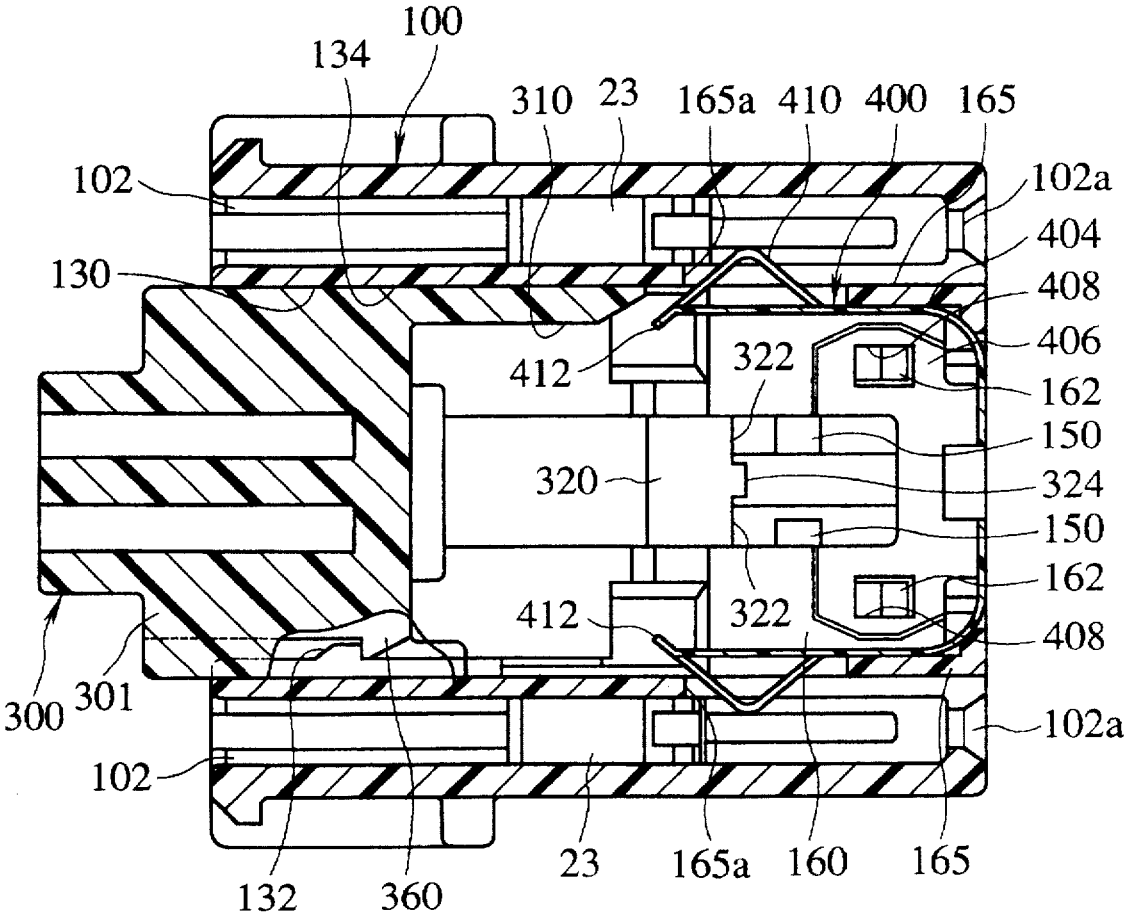
FIG. 11 is a sectional view taken in the direction of the arrow XI—XI in FIG. 6.

FIGS. 4 to 11 are figures showing a state where the slider is integrated into the male type connector housing 100 and is temporarily fitted in it. Among them FIG. 4 is a side view, FIG. 5 is a plan view, FIG. 6 is a view in the direction of the arrow VI—VI (rear view) in FIG. 4, FIG. 7 is a view in the direction of the arrow VII—VII (front view) in FIG. 4, FIG. 8 is a sectional view taken in the direction of the arrow VIII—VIII in FIG. 4, FIG. 9 is a sectional view taken in the direction of the arrow IX—IX in FIG. 6, FIG. 10 is a sectional view taken in the direction of the arrow X—X in FIG. 6, and FIG. 11 is a sectional view taken in the direction of the arrow XI—XI in FIG. 6.

As shown in FIG. 10, the terminal insertion hole 102 of the male type connector housing 100 is open at its rear end and is open continuously with a hole **102*a* for connecting to its partner terminal at its front end. The terminal hole 102 is provided with a lance 180 for fixing the terminal inside it. The male type connector housing 100 is provided with a spacer 500 to be inserted into it from below so as to fix the terminal accommodated in the terminal insertion hole 102**.

As shown in FIGS. 1 and 5, a flexible locking arm 105 is provided on the upper surface of the male type connector housing 100. The flexible locking arm 105 has two parallel arms 107 extending ahead and two arms 109 extending sideways, and is supported at four points by incorporating the respective one-side ends of the arms 107 and 109 into one body with the outer wall of the male type connector housing 100. This flexible locking arm 105 is provided with an engaging part 112, which is positioned between the arms 107 extending ahead, of a locking mechanism for locking the female type connector housing 200. This engaging part 112 functions also as a first slider stopper.

The aggregate of the free ends of the four arm parts 107 and 109 is provided on its lower surface with an engaging wall face 114 which is to be caught by an engaging part (flexible locking part) 352 of the slider 300 described later when the slider is inserted to the actual engaging position (although FIG. 9 shows a state of temporary engagement). As shown in FIG. 11, a temporarily engaging projection 132 for temporarily engaging with a temporarily engaging projection 360 of the slider 300 side is provided on each of both side walls of the slider accommodating room 130. A guide groove 134 for guiding a forward and a backward movement of the slider 300 are formed on each of both side walls of the slider accommodating room 130 (see FIGS. 1 and 6).

As shown in FIG. 7, a release projection accommodating hole (room for containing a release projection) 140 and a short-circuiting spring accommodating room 160 are formed at the front end of the male type connector housing 100, and a short-circuiting spring 400 is accommodated in the short-circuiting spring accommodating room 160.

As shown in FIG. 11, the short-circuiting spring 400, which is made by bending an elastic steel plate, has a pair of splint plates 406 respectively above and below an elastic arm 404 U-shaped in a plan view and is fixed inside the male type connector housing 100 by making engaging holes 408 of the lower splint plate 406 engage with engaging projections 162 of the short-circuiting spring accommodating room 160.

The terminal holes 102 and 102 are adjacent to both sides of the short-circuiting spring accommodating room 160 through separating walls 165, and a slit **165*a* is formed in each of said separating walls 165. A dogleg-shaped contact piece 410 is provided at a side of the front end of the elastic arm 404 and the top of the dogleg-shaped contact piece 410 enters into the terminal accommodating room 102 through the slit 165*a*. When the slider 300 is in a temporary engaging position shown in the figure, the dogleg-shaped contact piece 410 is in contact with a terminal 23 inserted and fixed in the terminal accommodating room 102**.

The release projection accommodating hole 140 is formed below the short-circuiting spring accommodating room 160, and a pair of second slider stoppers 150 are formed on both side walls of the release projection accommodating hole 140.

The second slider stoppers 150 secure an interval between them into which a guide projection 208 of a release projection 206 (second release projection) of the female type connector housing 200 described later can enter. A reinforcing rib accommodating groove (reinforcing rib accommodating part) **140*a* for accommodating a reinforcing rib 207 of the release projection 206 described later is formed continuously with the release projection accommodating hole 140, corresponding to the position and shape of the corresponding reinforcing rib 207**.

As shown in FIGS. 9 and 11, the slider 300 has a first flexible arm 340 and a second flexible arm 320 respectively extending ahead in about parallel with each other at the upper and the lower part of the front end of its maibody 301, has a pair of cutout arms 310 of thin-plate shape respectively extending ahead in parallel with each other at the right and the left part of the front end of it, has the temporarily engaging projections 360 for engaging with the temporarily engaging projections 132 of the slider accommodating room 130 at both sides of the lower part of the main body 301, has an operating part 350 on the upper surface of the main body 301, and has in front of the operating part 350 an engaging part 352 for preventing a bending deformation of the flexible locking arm 105 as opposed to the engaging wall face 114 of the flexible locking arm 105 when the slider 300 is moved to the actual engaging position.

A pair of engaging projections 342 and 342 to strike against the engaging part 112 of the locking mechanism of the male type connector housing 100 and a supporting wall 344 extending farther onward are formed on the upper surface of the first flexible arm 340 of the slider 300. An engaging projection 321 is formed on the lower surface of the front end of the second flexible arm 320, striking walls 322 for striking against the second slider stoppers 150 are formed at the right and the left side of the front end of the engaging projection 321, and a guide slope 324 is formed between both striking walls 322.

As shown in FIG. 9, when the slider 300 is in a temporary engaging position, the engaging projection 321 of the second flexible arm 320 engages with an engaging projection 133 provided on the bottom surface of the slider accommodating room 130 to prevent the slider 300 from slipping off. The cutout arm 310 shown in FIG. 11 slides along the guide groove 134 as being fitted into the guide groove 134 formed on each of both right and left inner side walls of the short-circuiting spring accommodating room 160.

Next, the female type connector housing 200 is described in the following.

Figure 12:
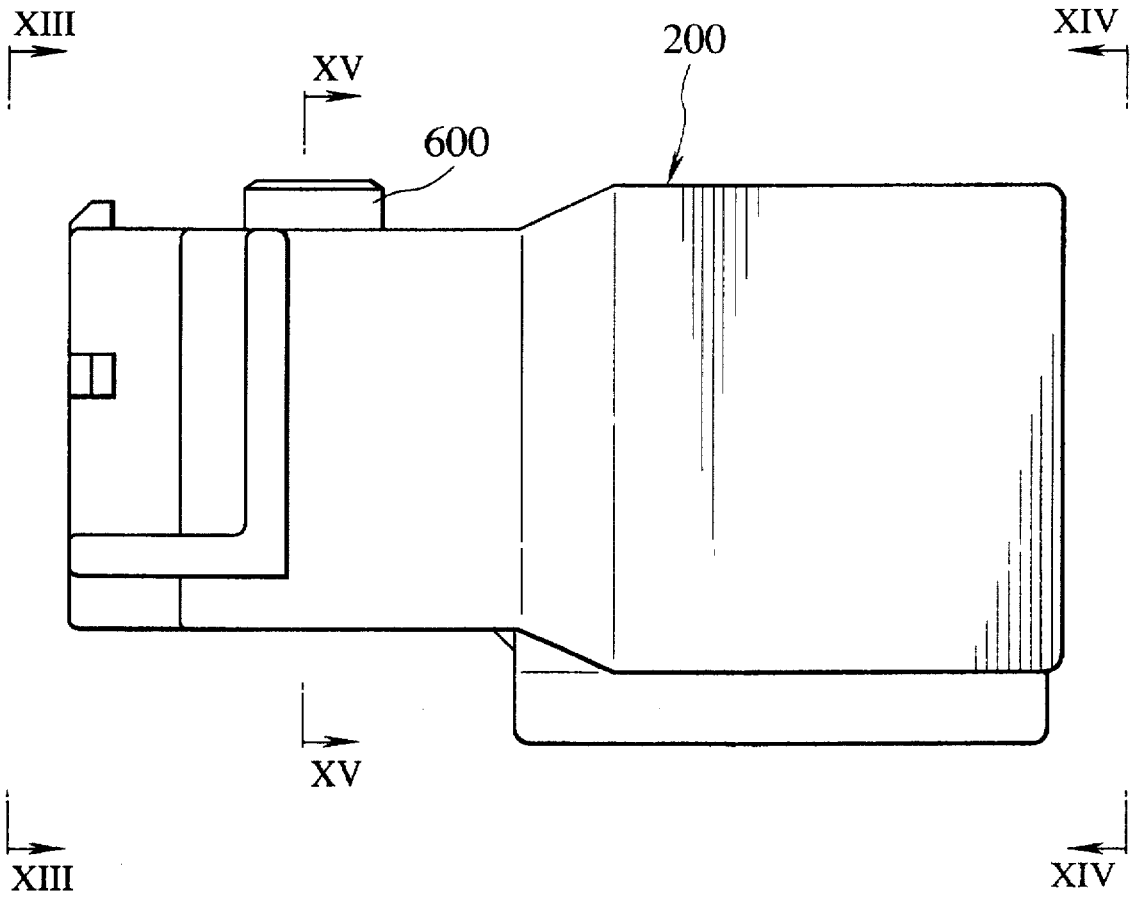
FIG. 12 is a side view showing a female type connector housing 200 in an embodiment of the invention.
Figure 13:
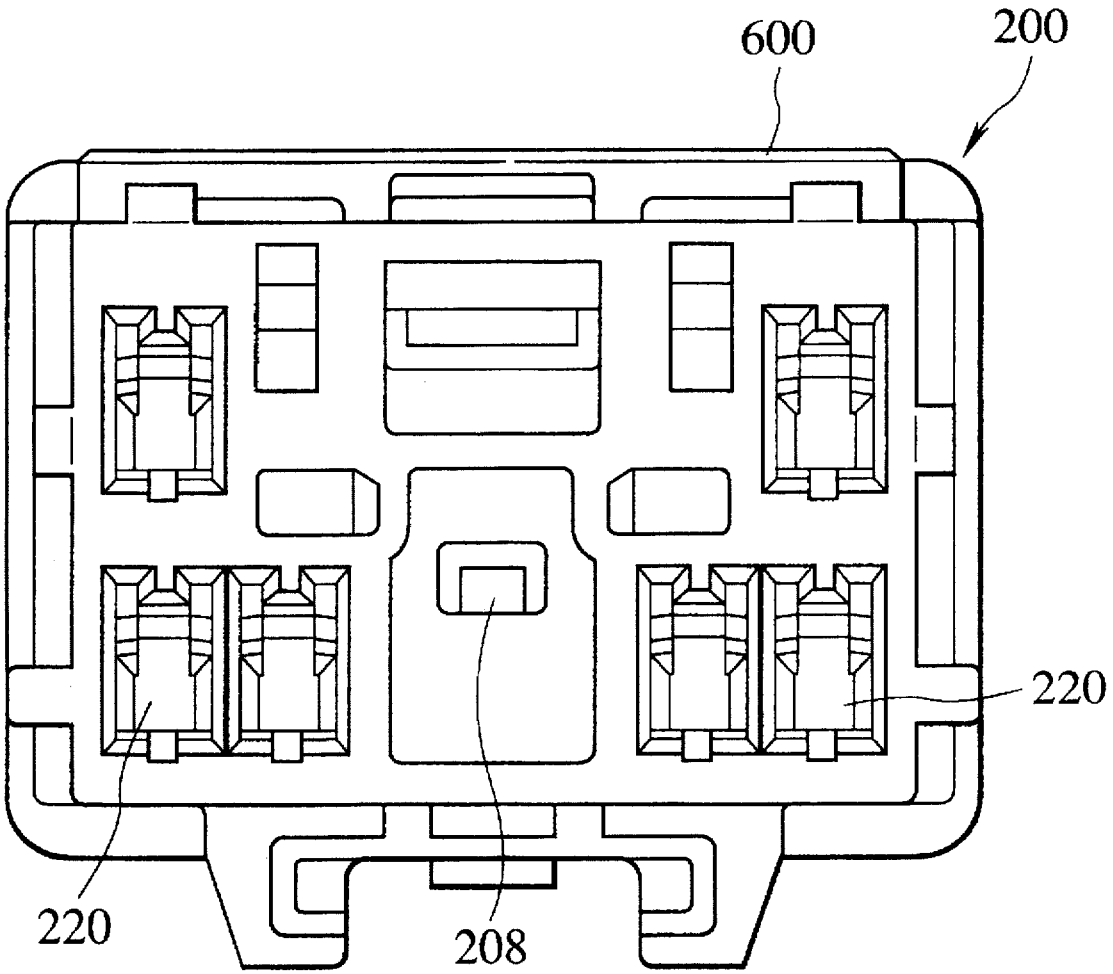
FIG. 13 is a view in the direction of the arrow XIII—XIII in FIG. 12.
Figure 14:
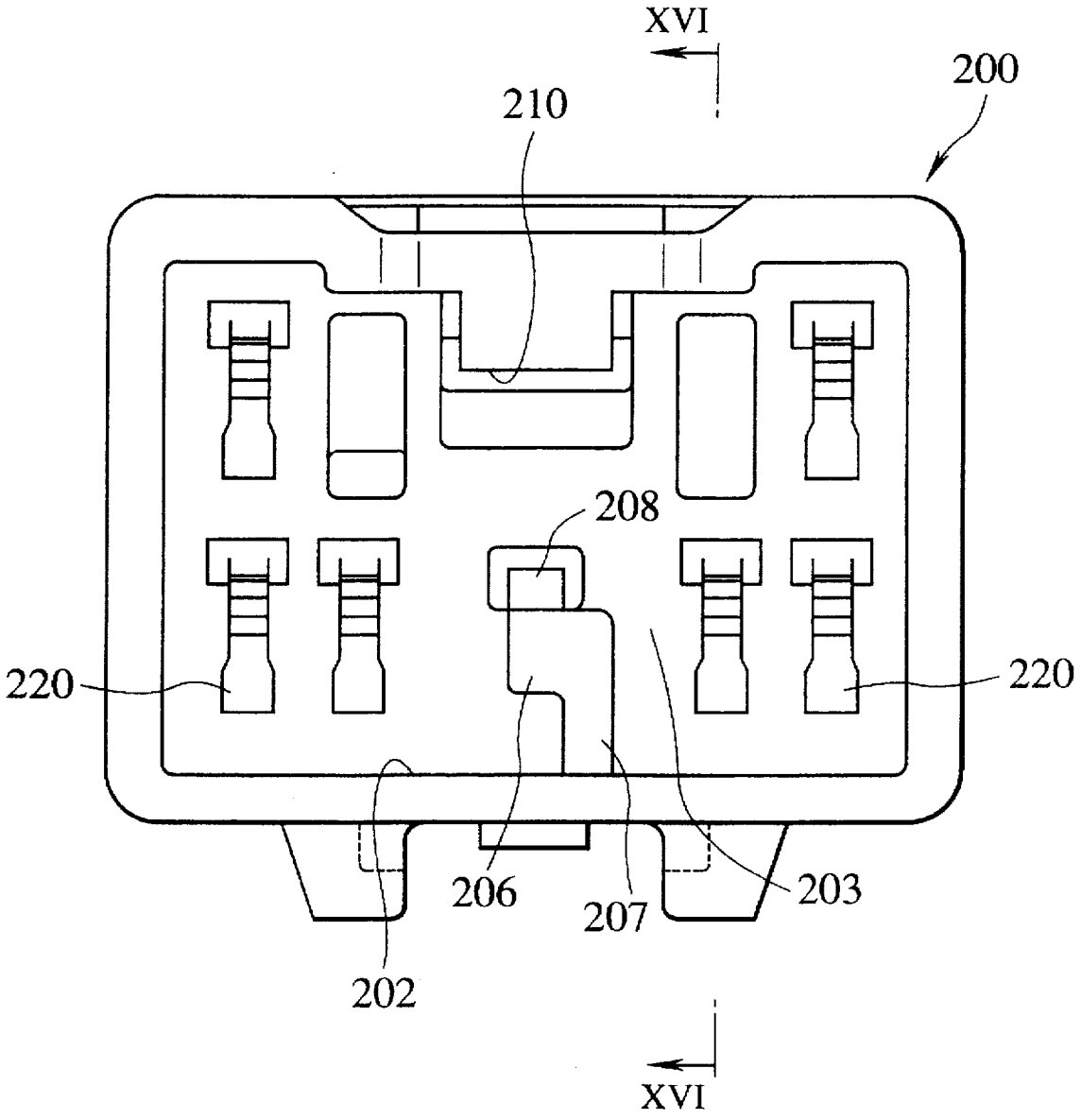
FIG. 14 is a view in the direction of the arrow XIV—XIV in FIG. 12.
Figure 15:
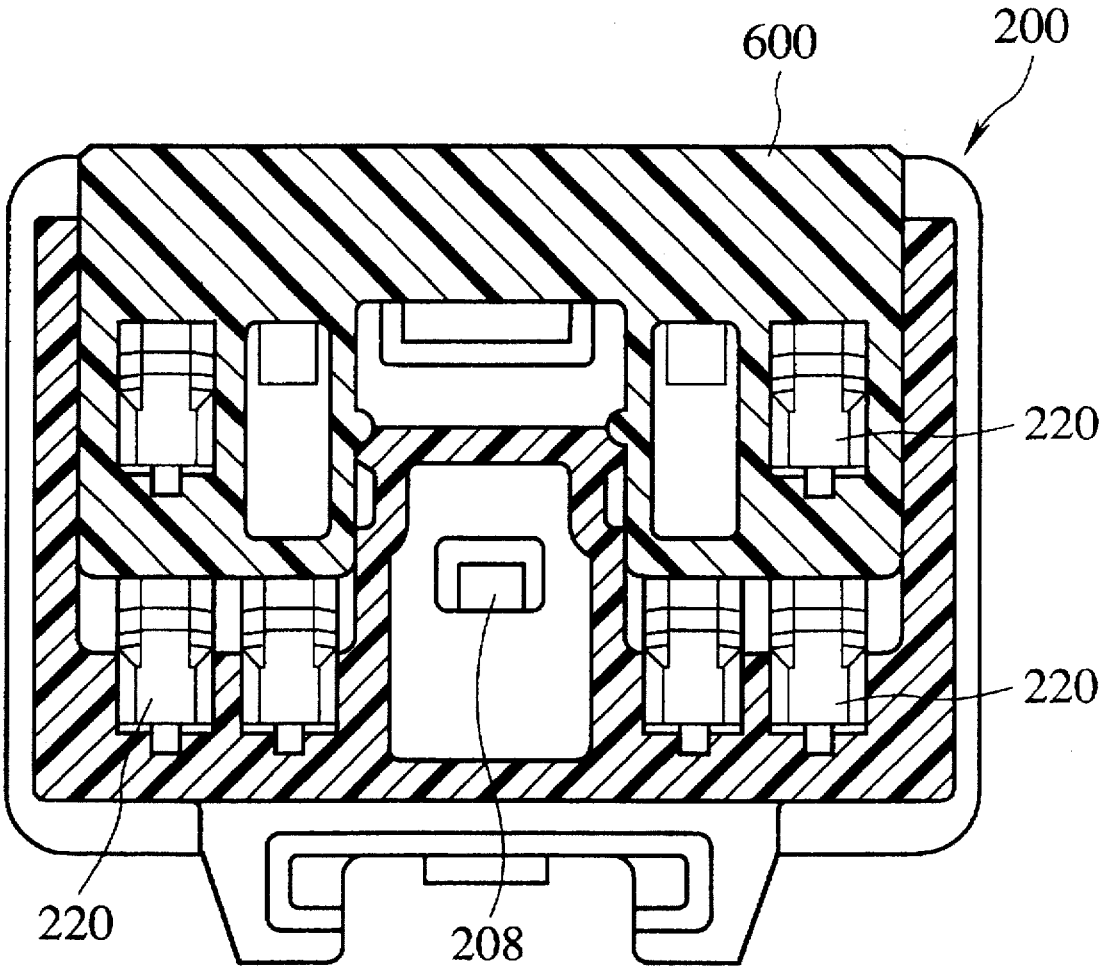
FIG. 15 is a sectional view taken in the direction of the arrow XV—XV in FIG. 12.
Figure 16:
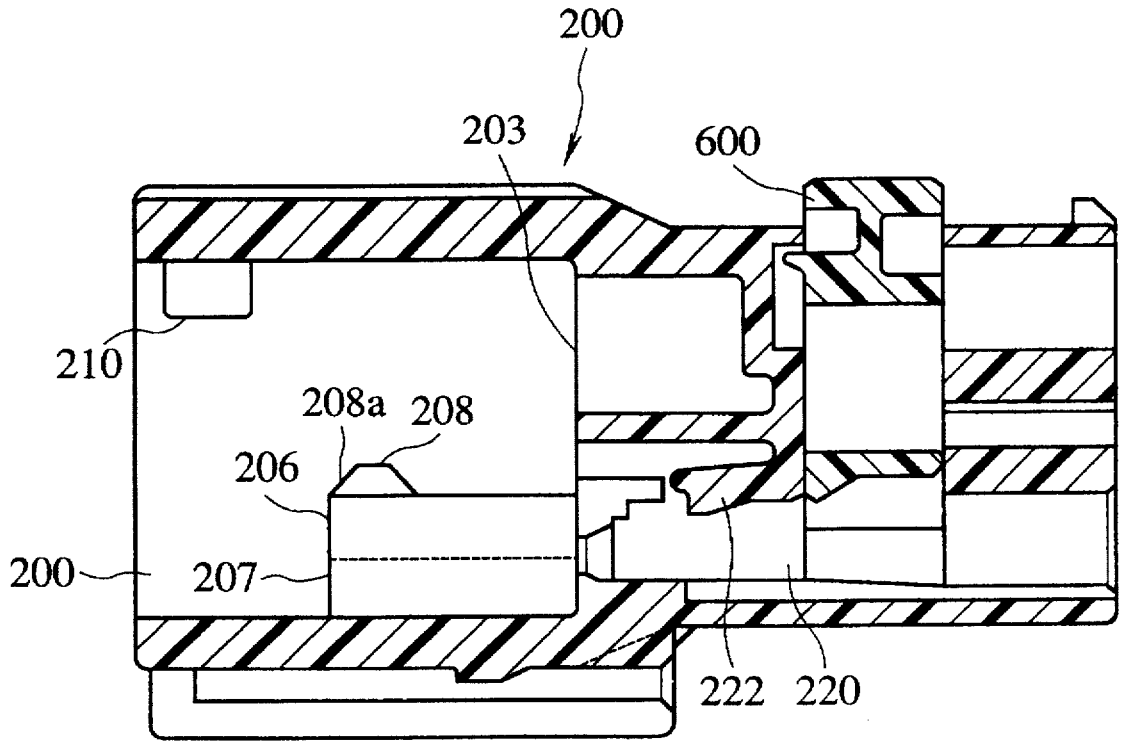
FIG. 16 is a sectional view taken in the direction of the arrow XVI—XVI in FIG. 14.

FIGS. 12 to 16 are figures showing composition of the female type connector housing 200. FIG. 12 is a side view, FIG. 13 is a view in the direction of the arrow XIII—XIII in FIG. 12, FIG. 14 is a view in the direction of the arrow XIV—XIV in FIG. 12, FIG. 15 is a sectional view taken in the direction of the arrow XV—XV in FIG. 12, FIG. 16 is a sectional view taken in the direction of the arrow XVI—XVI in FIG. 14.

As shown in FIGS. 14 and 16, the female type connector housing 200 has a male type connector accommodating room 202 for accommodating the male type connector housing 100, and has a back wall 203 having a plurality of terminal insertion holes 220 formed in it at the back of the room 202. A terminal fixing lance 222 is provided inside each terminal insertion hole 220. A spacer 600 is to be inserted into the female type connector housing 200 from above so that a terminal accommodated in the terminal insertion hole 220 can be fixed.

A release projection 206 projecting ahead is provided in the central part of the back wall 203 of the male type connector accommodating room 202. This release projection 206 is to be inserted into the release projection accommodating hole 140 of the male type connector housing 100, and a reinforcing rib 207 is formed continuously with the projection 206 in a specified position of the circumferential surface of it. The reinforcing rib 207 in this case is formed in a different position for each kind of connectors to prevent a wrong coupling. In this embodiment for example as shown in FIG. 14, it is disposed at the right side of the center line as seen from the front. By disposing it at the right, the left, or the center position, it is possible to distinguish the three kinds of connectors.

This reinforcing rib 207 is to be accommodated in the reinforcing rib accommodating groove **140*a* provided in the male type connector housing 100, and the reinforcing rib 207 and the reinforcing rib accommodating groove 140*a* correspond to each other only when connector housings 100 and 200** are right to each other.

The release projection 206 is provided with a guide projection 208 having a guide surface **208*a* for guiding the slider 300 to a position where the flexible arm 320 gets over the second slider stoppers 150 by bending upward the second flexible arm 320 through making the guide projection 208 touch and slide on the guide slope 324 of the front end of the second flexible arm 320 of the slider 300. Width of the guide projection 208 is determined so that it can pass between the second slider stoppers 150**.

On the upper inside wall of the male type connector accommodating room 202 is provided an engaging part 210 of the locking mechanism for engaging with the engaging part 112 of the flexible locking arm 105 of the male type connector housing 100. This engaging part 210 functions also as a first release operation part.

Figure 17:
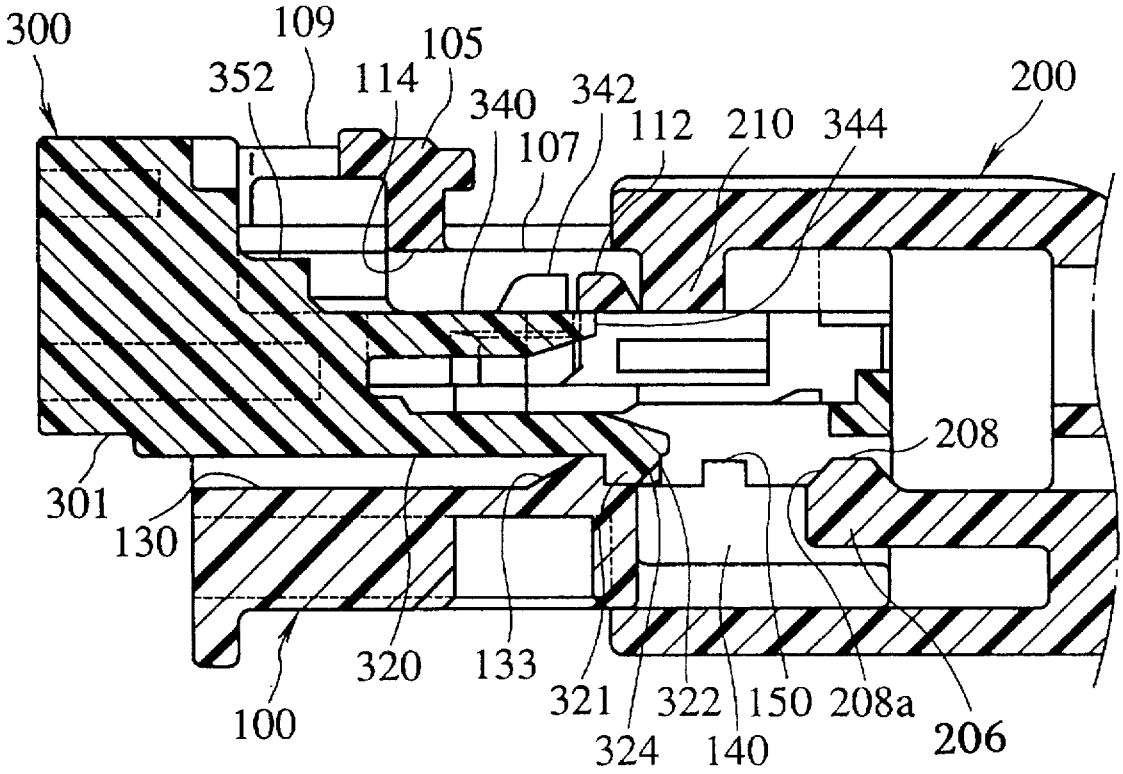
FIG. 17 is a sectional view showing a state corresponding to FIG. 1.

Next, operation of the embodiment is described in the following with reference to FIGS. 17 to 19.

In a state where the short-circuiting spring 400 is assembled and terminals are inserted into the male type connector housing 100, as shown in FIG. 11, the dogleg-shaped contact pieces 410 of the short-circuiting spring 400 are in contact with terminals 23 inside the terminal insertion holes 102 in both sides of the short-circuiting spring accommodating room 160, and the two terminals 23 are short-circuited by this. In a state where the slider 300 has been inserted to the temporary engaging position, as shown in FIG. 17, the engaging projections 342 of the first flexible arm 340 of the slider 300 are opposed to the engaging parts 112 of the flexible locking arm 105 of the male type connector housing 100 and thus the slider 300 is blocked to go farther ahead. At the same time, the slider 300 is blocked by that the striking walls 322 of the engaging projections 321 provided at the front end of the second flexible arm 320 are opposed to the second slider stoppers 150.

Figure 18:
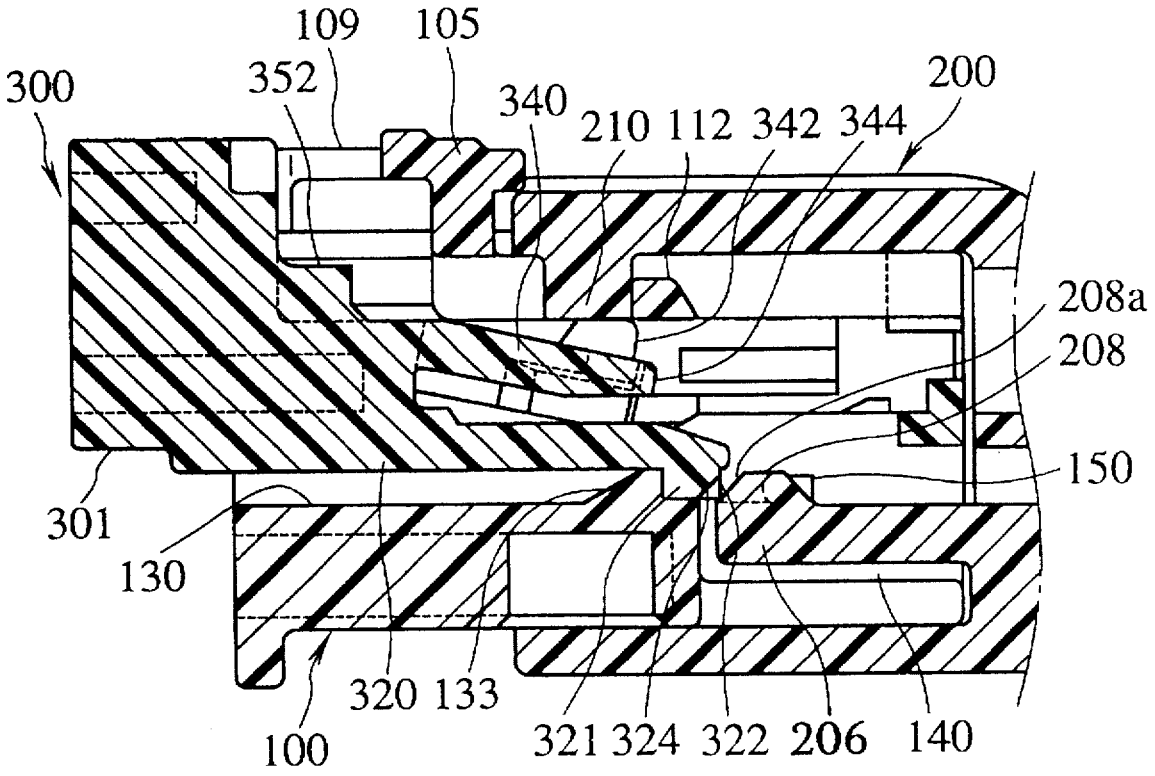
FIG. 18 is a sectional view showing a state corresponding to FIG. 2.
Figure 19:
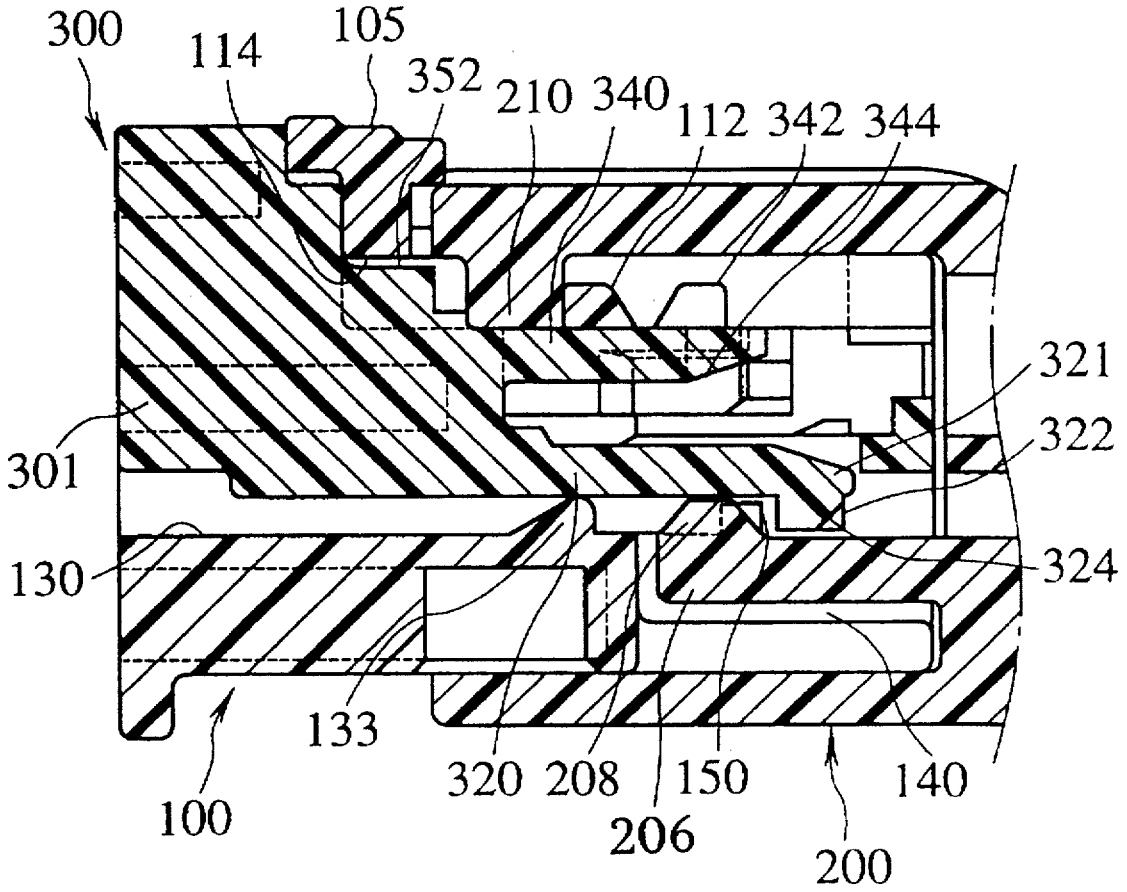
FIG. 19 is a sectional view showing a state corresponding to FIG. 3.

When coupling the female type connector housing 200 with the male type connector housing 100 in this state, as shown in FIG. 18, the engaging part 210 of the female type connector housing 200 gets over the engaging part 112 of the flexible locking arm 105 of the male type connector housing 100 to engage with its opposite side, and thus both connector housings 100 and 200 are completely coupled with each other and the terminals of both connector housings 100 and 200 are electrically connected with one another. At this time, since the engaging projection 342 of the first flexible arm 340 of the slider 300 which has previously engaged in a position where the engaging part 210 of the female type connector housing 200 is positioned is pressed downward, the first flexible arm 340 is bent downward.

By that the guide projection 208 of the front end goes ahead between the second slider stoppers 150, the release projection 206 enters into the release projection accommodating hole 140 of the male type connector housing 100 and the guide surface **208*a* of the guide projection 208 goes ahead to a position where it touches and slides on the guide slope 324 of the front end of the second flexible arm 320**.

In this case, if the connector housings 100 and 200 to be coupled are right to each other, since the reinforcing rib 207 of the release projection 206 (see FIGS. 14 and 16) enters just into the reinforcing rib accommodating groove **140*a* (see FIG. 7) provided continuously with the release projection accommodating hole 140, the connector housings 100 and 200 can be coupled with each other. However, if attempting to couple with each other connector housings 100 and 200 which are wrong to each other, since the reinforcing rib accommodating groove 140*a* and the reinforcing rib 207 do not match with each other in position, the reinforcing rib 207 does not enter into the reinforcing rib accommodating groove 140*a* and the connector housings 100 and 200** cannot be coupled with each other. Thus it is possible to prevent a wrong coupling of connector housings.

In a state shown in FIG. 18, the slider 300 is progressed ahead. Whereupon, the guide slope 324 of the front end of the second flexible arm 320 touches and slides on the guide surface **208*a* of the release projection 206 and the second flexible arm 320 is bent upward, and then the striking wall 322 of the second flexible arm 320 is guided to a position where it can avoid striking against the second slider stopper 150. The engaging projection 342 of the first flexible arm 340 is guided to a position where it can avoid striking against the engaging part 112 of the flexible locking arm 105. Therefore, the slider can be progressed ahead from the temporary engaging position without obstacles. When the slider 300 is progressed ahead, the engaging projection 321 of the second flexible arm 320 of the slider 300 gets over the second slider stopper 150 to engage with the slider stopper 150 in the opposite side of it, and the slider 300** is locked not to slip off in the actual engaging position.

In the actual engaging position, since the main body 301 of the slider 300 comes in contact with the rear end of the flexible locking arm 105 of the male type connector housing 100, the slider 300 is also locked not to go farther ahead. By that the engaging part 352 of the slider 300 crawls under the engaging wall face 114 of the flexible locking arm 105 in this state, the flexible locking arm 105 is prevented from bending. An engaging state where the engaging part 210 of the female type connector housing 200 and the engaging part 112 of the flexible locking arm 105 engage with each other is firmly kept by preventing the flexible locking arm 105 from bending, and thus the male type connector housing 100 and the female type connector housing 200 are double locked so as not to be easily slipped off.

At the time of this actual engagement, the front end of the cutout arm 310 (see FIG. 11) of the slider 300 wedges itself in between the dogleg-shaped contact piece 410 and the contact part of the terminal 23 and separates the contact piece 410 from the terminal 23 to cancel short-circuit between the terminals. Thus, by cancellation of the short-circuit, it is possible to confirm that the slider 300 has surely reached the actual engaging position.

In this manner, in a connector according to this embodiment, the slider cannot be progressed ahead from the temporary engaging position in a state where the male type connector housing 100 and the female type connector housing 200 have not been completely coupled with each other, and the slider 300 can be progressed from the temporary engaging position to the actual engaging position only in a state where they have been completely coupled with each other. Thus it is possible to detect a coupling state of the connector housings 100 and 200.

This embodiment can surely stop the slider 300 in a temporary stop position by means of two slider stoppers, namely, the first and the second slider stopper (the engaging part 112 and the second slider stopper 150). Since the second slider stopper 150 and the second flexible arm 320 are inside the male type connector housing 100, there is not a possibility that an external force is applied to the second flexible arm 320 and so there is not a possibility that the action of preventing the slider 300 from progressing is cancelled by accident. Therefore, there is not a possibility that the slider is moved from the temporary engaging position despite of an incomplete coupling state. And when the connector housings 100 and 200 have been completely coupled and the engaging parts 112 and 210 of the locking mechanism come to be surely locked, the action of blocking movement of the first flexible arm 340 is cancelled and the slider comes to be able to move, and therefore a complete coupling state and a locked state of the connector housings can be confirmed at the same time.

It is possible to prevent a wrong coupling of connectors by means of the reinforcing rib accommodating groove **140*a* and the reinforcing rib 207 provided on the release projection 206 for cancelling a temporary engagement of the slider 300**. Therefore, it is not necessary to provide an extra means for preventing a wrong coupling, and so the connector is not enlarged in size and an amount of molding material for it is not increased.

Furthermore, since the reinforcing rib 207 formed on the outer circumferential surface of the release projection reinforces the release projection 206 which is a cantilever projecting from the back wall 203, even if the front end of the slider 300 strikes against the end of the release projection 206 when releasing a temporary engagement of the slider 300, the release projection 206 can be prevented from deformation and it is possible to surely release the temporary engagement. Particularly, since the reinforcing rib 207 reaches the inner circumferential wall of the connector housing 200, not only it has a high reinforcing effect upon the release projection 206 but also the reinforcing rib 207 itself is improved in strength and can prevent deformation of it.

Still further, the reinforcing rib 207 may not extend to reach the inner circumferential wall of the connector housing 200.

What is claimed is:

1. A device for preventing a wrong coupling of a connector, comprising;

a pair of connector housings to be coupled face to face with each other, a slider mounted on one of the connector housings so as to be freely slid, which is unable to be moved to an actual engaging position and is stopped at a temporary engaging position when both connector housings are incompletely coupled as well as is able to be moved to the actual engaging position when they are completely coupled, a release projection, which is provided on the back wall of the other connector housing so as to project from it, for cancelling a temporary engagement of the slider by entering into an insertion space of one connector housing when the connector housings are completely coupled, a reinforcing rib provided at a specified position on the circumferential surface of the release projection, and a reinforcing rib accommodating part provided continuously with the insertion space, which can accommodate only the reinforcing rib provided in a specified position and cannot accommodate the reinforcing rib provided in any other position than the specified position.

2. A device for preventing a wrong coupling of a connector as defined in claim 1, wherein;

said reinforcing rib is extended to the inner circumferential wall of the other connector housing and is continued with said inner circumferential wall.

3. A device for preventing a wrong coupling of a connector as defined in claim 1, wherein;

said one connector housing is provided with a flexible locking arm for locking both connector housings in a complete coupling state, and said slider is provided with a bending locking part for preventing said locking arm from bending in a direction of releasing an engagement when said slider is moved to an actual engaging position.

4. A device for preventing a wrong coupling of a connector as defined in claim 1, wherein;

said one connector housing is provided with a first and a second stopper for stopping said slider in said temporary engaging position by blocking movement of said slider to the actual engaging position, said slider is provided with a first and a second flexible arm, respectively, having engaging parts corresponding to said first and said second stopper, said other connector housing is provided with a first and a second release operation part for cancelling said first and said second stopper's action of blocking movement of said slider when said connector housings are completely coupled, at least one of said first and said second stopper is disposed inside said one connector housing, and said release projection is provided as a release operation part corresponding to the stopper disposed inside.

* * * * *